US005752779A

United States Patent [19]

Passer et al.

[11] Patent Number: 5,752,779

[45] Date of Patent: May 19, 1998

[54] AUTOMATIC JOURNAL-LOADING ASSEMBLY

[75] Inventors: Barry E. Passer, Newfield; Michael J. Smith; Robert Delaney, both of Ithaca, all of N.Y.

[73] Assignee: Axiohm IPB Inc, Ithaca, N.Y.

[21] Appl. No.: 697,754

[22] Filed: Aug. 28, 1996

Related U.S. Application Data

[63] Continuation-in-part of Ser. No. 617,255, Mar. 18, 1996, Pat. No. 5,613,787.

[51] Int. Cl.[6] ..... B41J 15/02

[52] U.S. Cl. ..... 400/613.1; 242/332.8; 242/386.4; 242/532.5

[58] Field of Search ..... 400/613.1, 613, 400/614, 250; 242/586.4, 532.5, 332, 332.1, 332.2, 332.3, 332.4, 332.5, 332.8; 101/288; 226/91, 92

[56] References Cited

U.S. PATENT DOCUMENTS

| | | | |
|---|---|---|---|
| 117,630 | 8/1871 | Hillard | 242/586.4 |
| 519,465 | 5/1894 | Allen | 242/586.4 |
| 793,672 | 7/1905 | Lyter | 242/586.4 |
| 885,472 | 4/1908 | Hegarty | 242/586.4 |
| 1,288,748 | 12/1918 | Thomas | 242/532.5 |
| 4,531,684 | 7/1985 | Mills | 242/586.4 |
| 4,772,146 | 9/1988 | Saito et al. | 400/613.1 |
| 5,613,787 | 3/1997 | Passer et al. | 400/613.1 |

FOREIGN PATENT DOCUMENTS

| | | | |
|---|---|---|---|
| 655825 | 4/1929 | France | 242/586.4 |
| 21271 | 10/1898 | United Kingdom | 242/532.5 |

*Primary Examiner*—Edgar S. Burr
*Assistant Examiner*—Daniel J. Colilla
*Attorney, Agent, or Firm*—Salzman & Levy

[57] ABSTRACT

The present invention features an apparatus for a journal-receipt printing machine. The apparatus semi-automatically loads the journal paper onto the take-up spool. The machine also has a drop-in, loading capability for the journal-paper supply-roll. The journal-printing apparatus utilizes a duckbill, take-up core or spool that is bifurcated into stationary and movable sections. The bifurcated spool is spring-loaded, and is caused to bias-close through the movement on the cam surface. The leader of the journal paper is placed over the stationary section of the spool. The gear train causes the cam follower to turn over the cam surface and close. The gear train then forces the duckbill spool shut against its biasing, thus capturing the paper between the spool sections. In this fashion, the procedure of resupplying the machine with journal paper is accomplished without the user having to thread paper. A pair of rollers positioned within the spool allows the captured leader of the journal paper to be easily removed from the closed spool.

7 Claims, 4 Drawing Sheets

AUTOMATIC JOURNAL-LOADING ASSEMBLY

RELATED APPLICATIONS

This is a continuation-in-part of application Ser. No. 617,255 filed on Mar. 18, 1996, now U.S. Pat. No. 5,613,787.

FIELD OF THE INVENTION

The present invention pertains to retail receipt-printing mechanisms and, more particularly, to a retail receipt-printer having a transaction journal that can be loaded without the user needing to perform a manual, threading procedure.

BACKGROUND OF THE INVENTION

It is nowadays useful to validate customer checks at retail establishments and shopping markets. Small, desktop and countertop machines print receipts for transactions, as well as and validate customers' checks and other documents of legal tender. In addition to printing transaction receipts, these machines often keep a record, or a journal, of such transactions on a separate roll of journal paper. Not distributed to customers, this separate roll of journal paper is unloaded when completely used. One such machine is a Model No. 7221 printer, which is manufactured by Axiohm of Ithaca, N.Y.

Other commercially available machines of this type usually require cumbersome, manual threading of both their receipt supply-rolls and their journal-supply rolls, which record all of a store's commercial transactions.

The Axiohm machine, however, comprises a means by which the receipt-paper supply-roll can merely be dropped into a paper supply-bin disposed in the housing without the need for manual receipt-threading by the user. Moreover, this machine is a one-station device, i.e., only one movable print-head and one paper-path are used to print on a single supply of two-ply paper. One sheet is severed for customer receipts, and the other forms a continuous roll of journal-paper.

Drop-in loading of a receipt-paper supply-roll is already known, and proven to be most useful to store personnel, especially when the paper supply runs out at a busy time. This drop-in, receipt-paper feature allows for a quick resupply without manually threading it, thus preventing all but a minimum delay at a check-out counter.

It makes no sense, however, to streamline the customer-receipt, paper-loading procedure without doing the same for loading journal-paper, since any prolonged procedure that interrupts during customer check-out is anathema to efficient store management.

Journal printing has always been an especially difficult procedure. Most, if not all, receipt-printing machines require the user or operator to remove the spool and then thread the end of a new roll of journal paper through an opening therein. The spool or core is then rotated by hand in order to capture the journal paper onto the core. The entire procedure is not unlike the manual threading of movie film in obsolete cameras.

The aforementioned, previously-filed, parent application attempted to solve this problem of manually threading journal-paper. In addition to its paper-supply, drop-in capability, the aforesaid invention developed a means by which the recordkeeping journal-paper could be loaded without requiring operating personnel to engage in manual paper-threading. The mechanism for winding the journal paper was shaped like a split-sectioned "duckbill", with, in an open position, one section of the journal disposed at an angle with respect to its counterpart section. Journal paper was fed between the two duckbill sections, with the angled section then closed upon its counterpart section, thus entrapping the journal paper therebetween. The journal paper was easily and quickly drop-loaded into the supply bin. The leader of the supply roll was captured between feed rollers as the clamshell of the machine was closed, and then deposited over the duckbill, take-up core. This was accomplished without removing the duckbill, take-up core, and without any concern for its rotative position. In other words, the core was partially automatically-threaded. All the user needed to do was close the cover over the supply bin, and press the paper-advance switch after the supply roll was deposited in the bin.

In the course of product development, however, several problems arose which proved it necessary to provide improvements to the original design.

It was discovered that the closure of the two sections of the duckbill journal worked too well. The paper became entrapped between the two sections with such a force that it was difficult to remove the paper without tearing or telescoping it. This problem was resolved by providing a pair of rollers, with each one of the pair disposed opposite one another on respective portions of the duckbill, so as to allow the paper to be smoothly drawn from the journal core. When the two halves are closed, the only pressure on the paper is at the point of tangency of the two rollers, which allows a 0.010-inch gap between the two halves.

It is an object of this invention to provide an improved, journal-printing apparatus.

It is another object of this invention to provide a loading method for the journal-paper take-up spool that does not require manual paper-threading.

It is a further object of this invention to provide a journal-printing apparatus with an automatic, journal-paper resupply that allows for drop-loading of the supply paper.

It is yet another object of this invention to provide a journal-roll winding mechanism that, for easy removal, will lightly capture the paper in the wind-up core.

SUMMARY OF THE INVENTION

In accordance with the present invention, there is provided a journal-printing apparatus for a check-validating and receipt-printing machine that loads journal paper onto a take-up roll with no need for manual paper-threading. The machine is also characterized by a drop-in loading capability for the journal-paper supply-roll. The journal-printing apparatus comprises a take-up core or spool that is bifurcated into stationary and movable portions. (The terms "stationary" and "movable" are used herein to describe only the spool portions' angular movements with respect to one another, since both portions actually rotate about a common axis, as is described hereinbelow.)

The bifurcated spool is spring-loaded in an open position, but is caused to bias to its closed position by movement on a cam surface. The journal-paper roll-bucket is opened by the user, in order to drop-load the journal paper into the paper supply-bin. The spool forms a duckbill when the movable portion of it, rotating on the cam surface, separates from the stationary-spool portion. When separated from each other to their greatest extent, the two portions of the spool form approximately a 60° angle.

The user opens the clamshell housing and removes from the paper supply-bin the spent core which held the paper supply. The rewound, printed, journal-paper roll is then slid from the rewind core, and, after a four- or five-inch leader of paper is unwound, the user places a new supply-roll in the paper supply-bin. The paper-roll placing or "dropping" operation is from whence the term "drop-in loading" is derived. The leader is simply laid over the feed rolls, and the user closes the clamshell.

As the clamshell closes, the gears that are mounted thereupon turn the empty rewind spool and core one full revolution backwards (i.e., in the direction opposite the forward motion of the paper for printing). During this backwards revolution, the spring-loaded, duckbill spool passes the position in which it can spring open; it, therefore, springs open and is prevented from turning further in the backwards direction. The rewind clutch slips until the clamshell is closed; the clutch then disengages the rack, which engages the drive train. The user now simply lays the leader over the horizontal portion of the rewind spool, pushing the paper-advance button so that the drive motor advances the rewind spool in the forward direction. The cam on the rewind spool-bearing closes the spool and captures the leader.

This improved mechanism features a pair of rollers that are oppositely disposed from one another on respective portions of the duckbill core. These rollers hold the paper therebetween, and allow for the easy removal of the paper.

BRIEF DESCRIPTION OF THE DRAWINGS

A complete understanding of the present invention may be obtained by reference to the accompanying drawings, when considered in conjunction with the subsequent, detailed description, in which.

For the sake of brevity and clarity, all like components and elements of this invention will bear the same numerical designations throughout the FIGURES.

DESCRIPTION OF THE PREFERRED EMBODIMENT

Generally speaking, the invention features a journal-printing apparatus for semi-automatically loading journal-supply paper onto a take-up roll in a check-validating and receipt-printing machine. The apparatus is also characterized by means for drop-loading the paper supply-roll into the printing machine. In this fashion, the entire journal-printing procedure is greatly simplified, so that delays due to the need for paper resupply at check-out counters will now be a thing of the past in retail establishments. The take-up core of the invention features a novel, bifurcated, "duckbill" spool that is split lengthwise, approximately in half. The journal paper is deposited over the first half of the open spool, with the complementary portion of the spool then closing over the paper and thus capturing it. The closing of the bifurcated spool is triggered by the movement on or over a cam surface, which causes the first portion of the spool to descend. When the paper supply-bin is closed, the duckbill is rotated one turn. Similarly, when the clamshell is opened, the first, movable portion of the spool, which is spring-biased, opens with respect to the second portion thereof.

Closing or opening the clamshell initiates movement of a gear drive train that actuates the cam motion. The gear train movement is initiated by a toothed rack which is mounted in the printer itself.

Figure 1:
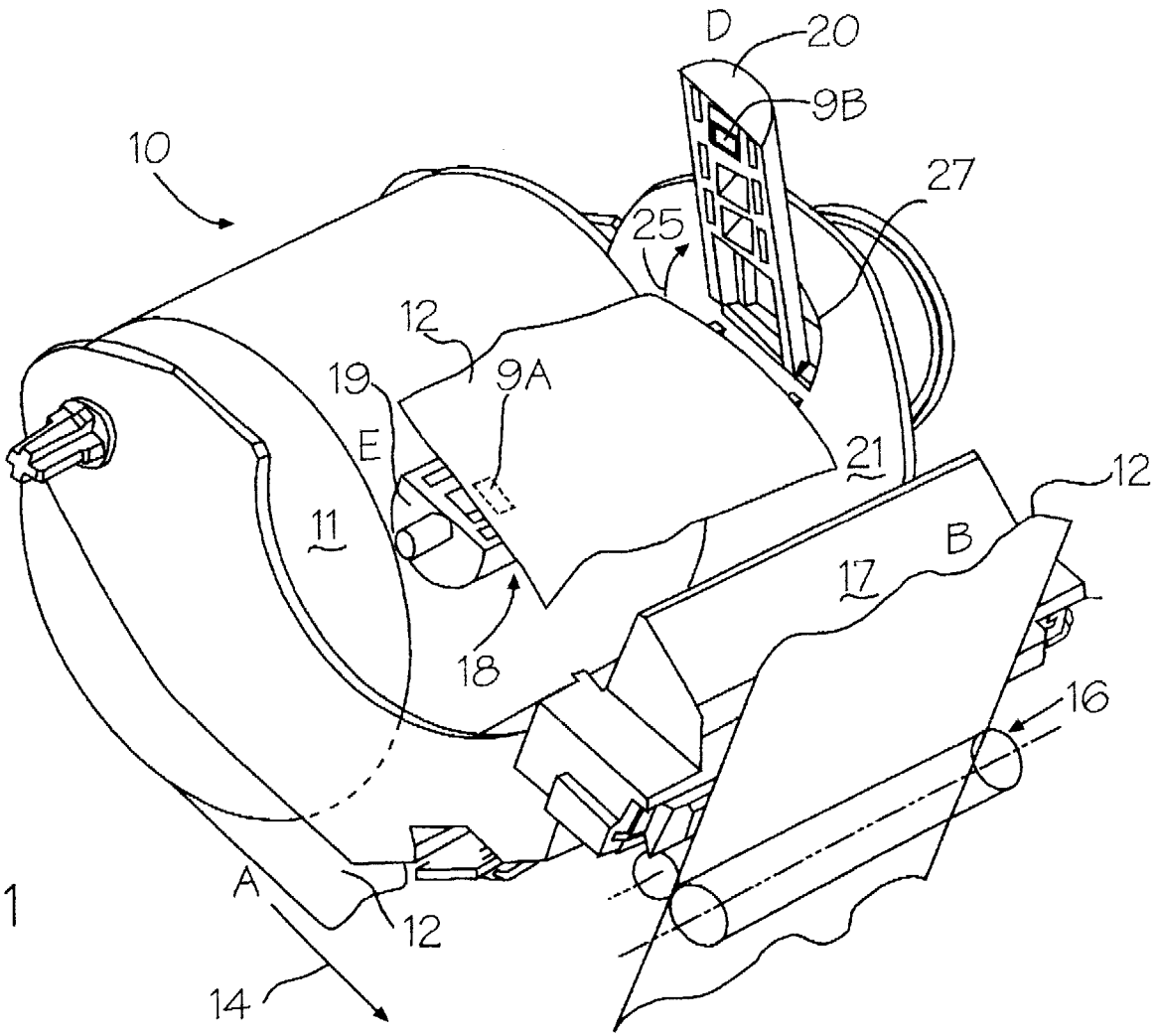
FIG. 1 illustrates a left-hand, perspective view of the threadless, journal-paper loading apparatus of this invention.
Figure 2:
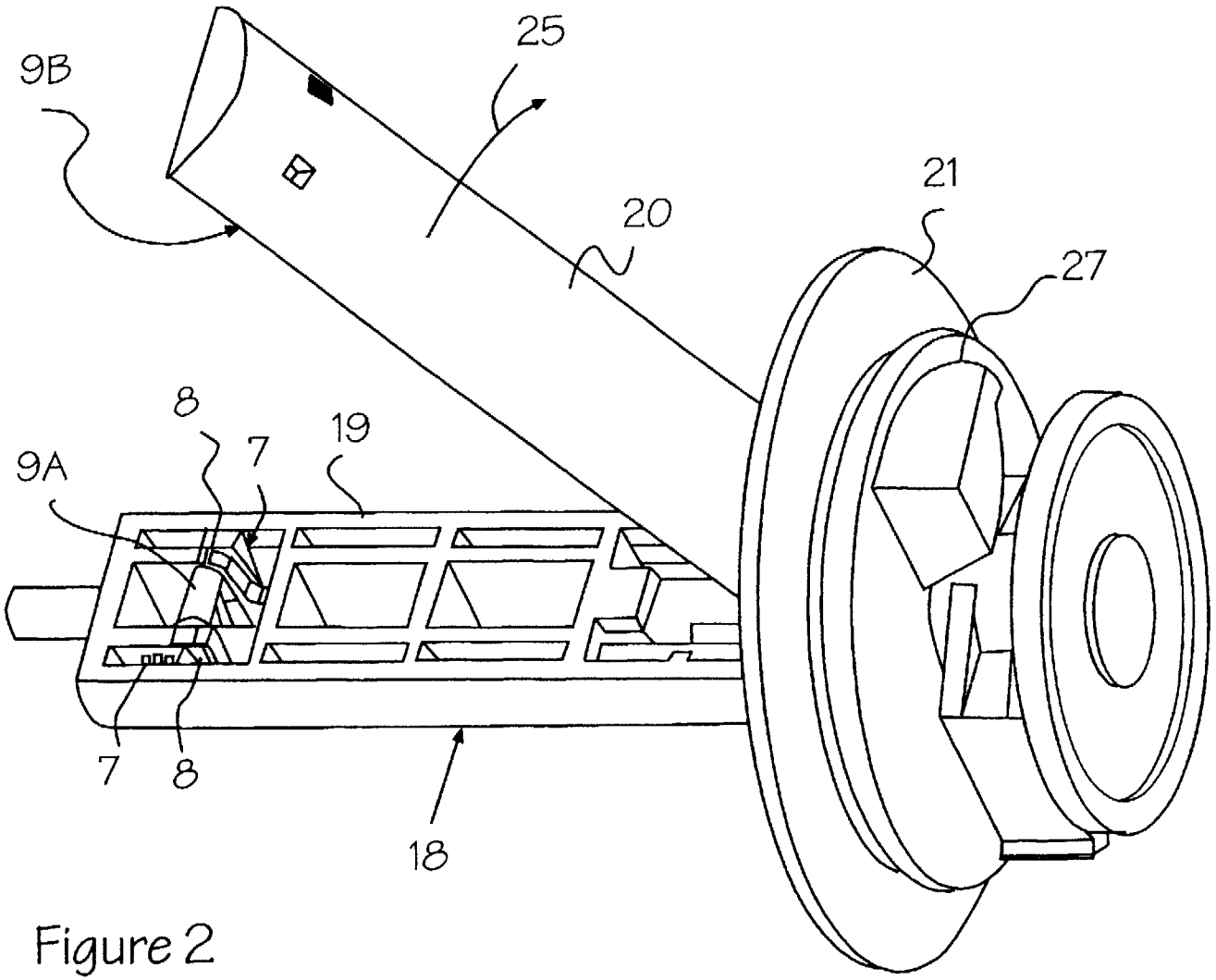
FIG. 2 depicts a right-hand, perspective view of the the journal-paper loading apparatus of this invention.

Now referring to FIGS. 1 and 2, the journal-paper loading-apparatus 10 of this invention is illustrated. The journal-paper loading-apparatus 10 utilizes a drop-loaded supply roll of journal paper 11. The paper is two-ply, so that, when a receipt-printing function is also required, pressure-sensitive paper is used for the journal-printing function. In typical, Axiohm receipt-printing and check-validating machines, a hinged cover (not shown) is opened to expose a paper supply-bin (not shown), i.e., a hollowed-out portion of the printer housing. A clamshell 17 must be opened to receive the paper supply-roll 11. The paper supply-roll 11 is merely dropped into the exposed, paper supply-bin. A typical, Axiohm construction is illustrated in co-pending United States patent application, bearing Ser. No. 08/617,255 and filed on Mar. 18, 1996.

After the supply roll of journal paper 11 is deposited into the paper supply-bin of the machine, a leader of paper 12 is withdrawn (arrow 14) at position A, and directed past the printing platen 15, over the top of the clamshell 17 at position B. The leader of paper 12 is thereafter deposited between the two portions of the open, bifurcated, take-up, duckbill spool 18, at position C.

The bifurcated, take-up, duckbill spool 18 comprises a fixed (stationary) section 19 and a movable section 20, shown here in its open position which is angled by a minimum of approximately 60° with respect to the stationary section 19. The stationary section 19 is molded to a flange, and is mounted for subsequent rotation in a cam bearing 21, which is fixed in the clamshell. A take-up gear, attached to the bearing portion of the flange, rotates the spool 18 to effectuate the take-up or rewinding of the printed journal, after the paper leader 12 has been captured between the respective spool sections 19 and 20.

In assembling the printer, the spool 18 (which comprises stationary and movable sections 19 and 20, respectively) is inserted into bearing 21. The take-up gear is attached to take-up spool 18. This assembly is then snapped into the clamshell 17. A compound-gear-and-slip-clutch is then also snapped into the clamshell 17. Thus, all of the aforementioned components are mounted upon the movable clamshell 17.

Figure 3:
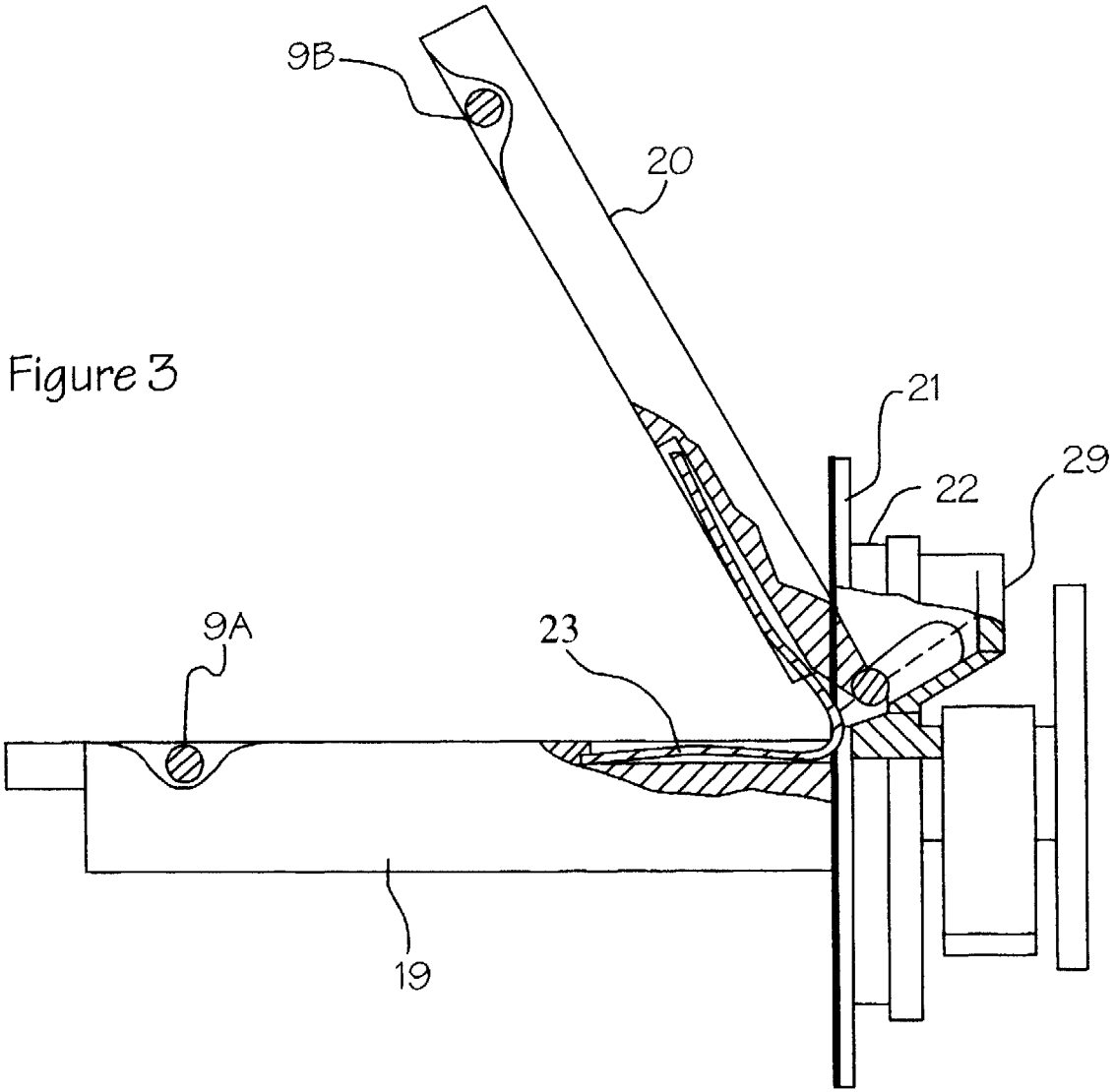
FIG. 3 shows a front, sectional view of the journal-paper loading device illustrated in FIG. 2.
Figure 4:
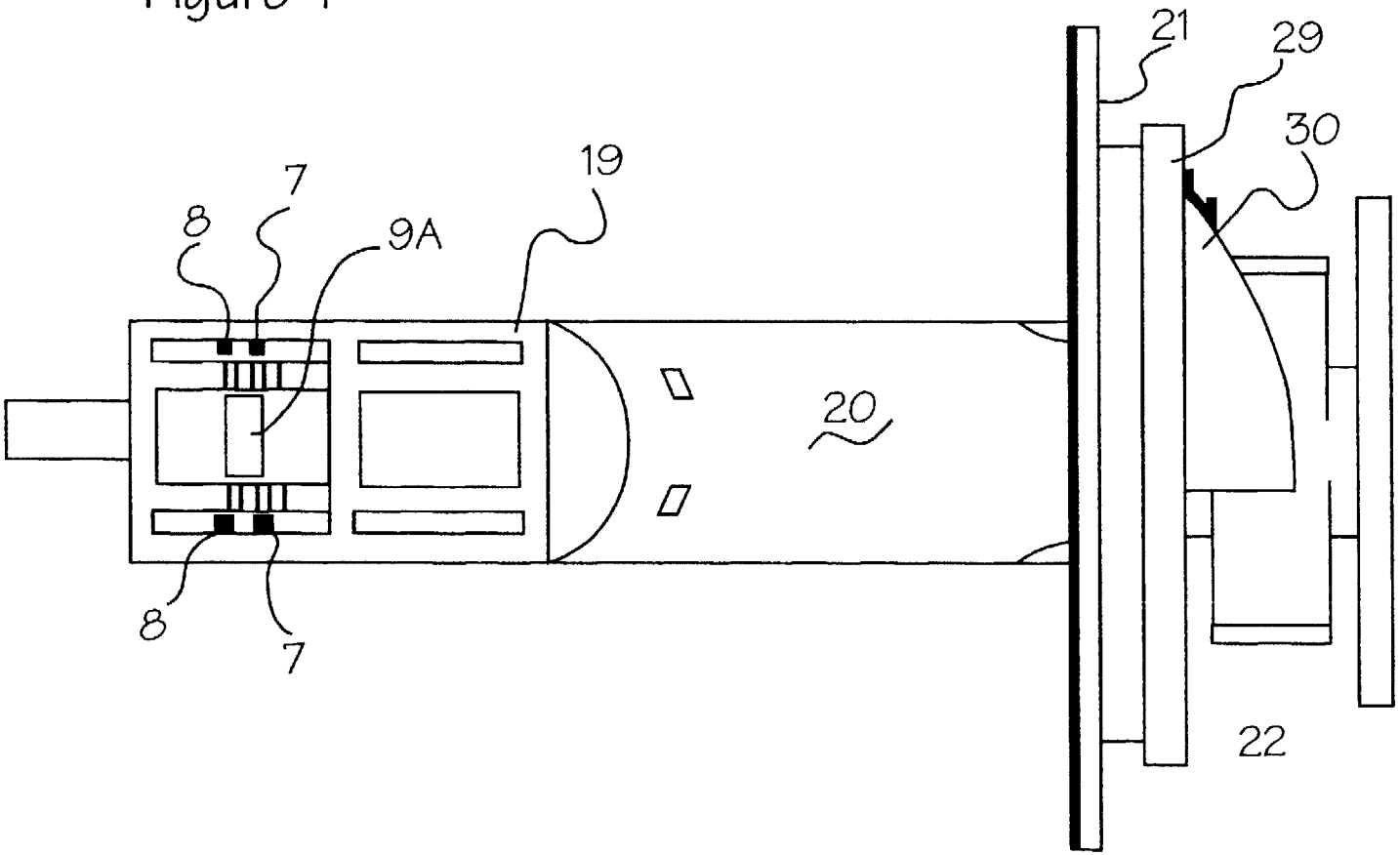
FIG. 4 illustrates a top view of the journal-paper loading apparatus shown in FIGS. 2 and 3, with the camming device in its forwardly rotated cam position.

Referring to FIGS. 3 and 4, the movable spool section 20 is shown as being pivotably movable about pin 22. A leaf spring 23 causes the upper, movable spool section 20 to be biased (arrow 25) toward the 60° angle (open position D), as illustrated. The movable spool section 20 projects through a window 27 in bearing 21. Pin 22 moves along the curved track 30 of cam 29 (FIG. 4) in order to open the spool 18.

The cam function is performed by the exterior of the bearing 21, with the two functions being performed by one component 21. It is utilized to cam the spool section 20 against its biasing spring 23, toward contact with the stationary spool section 19, in order to capture the paper leader 12 between the two spool portions 19 and 20 of the duckbill spool 18. The spool 18 is thus opened, position D, and remains open.

In order to allow for easy removal of the paper from the spool 18, it is useful to equip the spool 18 with a pair of rollers **9*a* and 9*b*, respectively. Roller 9*a* is rotationally mounted on the stationary spool section 19; its oppositely disposed roller, 9b, is rotationally mounted on the movable spool section 20. The respective right- and left-shafts 8 of each respective roller 9a and 9b are rotationally anchored within respective right- and leftwell sections 7. The rollers 9a and 9b are oppositely disposed from each other, and capture the paper between themselves when the spool sections 19 and 20 close. When the paper is caused to be withdrawn from the spool 18, the rollers 9a and 9b** also allow for the captured paper to slide over the rotatable rollers.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A journal-receipt printing apparatus for automatically threading a journal supply-paper onto a take-up roll, in a journal-receipt printing machine, comprising:

paper-deposit means for drop-loading a supply of journal paper into said journal-receipt printing machine;

a bifurcated, take-up spool adjacent said paper-deposit means for receiving a leader of said supply of journal paper when said spool is in an open position, and then capturing said leader of said supply of journal paper when said spool is in a closed position, said spool including a stationary section and a movable section, said movable section moving between said open position and said closed position;

said bifurcated take-up spool having a stationary section and a movable section, a pair of oppositely disposed, rotatable rollers, with each roller of said pair of oppositely disposed, rotatable rollers being rotatably anchored within said respective stationary and movable sections, said pair of oppositely disposed, rotatable rollers capturing the leader of the journal paper therebetween when said spool is in its closed position, said pair of oppositely disposed rollers allowing said captured journal paper to be easily removed from said spool after capture thereof; and drive means in operative contact with said movable section of said spool, for moving said movable section of said spool from between said open position and said closed position in order to receive and capture said leader of said supply of journal paper.

2. The journal-receipt printing apparatus in accordance with claim 1, further comprising biasing means in operative contact with said movable section of said bifurcated, take-up spool, for biasing said movable section towards said open position.

3. The journal-receipt printing apparatus in accordance with claim 2, wherein said drive means comprises a cam that is positioned adjacent said bifurcated, take-up spool, said cam having a follower surface that allows the movable section of said spool to move to said open position under the influence of said biasing means.

4. The journal-receipt printing apparatus in accordance with claim 1, wherein said bifurcated, take-up spool includes a clamshell-like configuration.

5. A journal-receipt printing apparatus for automatically threading journal supply-paper onto a take-up roll, in a journal-receipt printing machine, comprising:

paper-deposit means for drop-loading a supply of journal paper into said journal-receipt printing machine;

a bifurcated, take-up spool adjacent said paper-deposit means for receiving a leader of said supply of journal paper when said spool is in an open position, and then capturing said leader of said supply of journal paper when said spool is in a closed position, said spool including a stationary section and a movable section, said movable section moving between said open position and said closed position;

drive means in operative contact with said movable section of said spool, for moving said movable section of said spool between said open position and said closed position in order to receive and capture said leader of said supply of journal paper;

a rotatable roller being rotatably anchored within said spool, said rotatable roller allowing said captured journal paper to be easily removed from said spool after capture thereof; and biasing means in operative contact with said movable section of said spool, for biasing said movable section towards said open position.

6. The journal-receipt printing apparatus in accordance with claim 5, wherein said bifurcated, take-up spool includes a clamshell-like configuration.

7. The journal-receipt printing apparatus in accordance with claim 5, wherein said drive means comprises a cam that is positioned adjacent said bifurcated, take-up spool, said cam having a follower surface that allows the movable section of said spool to move to said open position under the influence of said biasing means.

* * * * *